US008669836B2

(12) United States Patent
Kulke et al.

(10) Patent No.: US 8,669,836 B2
(45) Date of Patent: Mar. 11, 2014

(54) MAGNETIC TRIGGER MECHANISM

(75) Inventors: Matthias Kulke, Dresden (DE); Thomas Roechke, Arnsdorf Deutschland (DE)

(73) Assignee: Johnson Electric Dresden GmbH, Dresden (DE)

( * ) Notice: Subject to any disclaimer, the term of this patent is extended or adjusted under 35 U.S.C. 154(b) by 0 days.

(21) Appl. No.: 13/379,929

(22) PCT Filed: Jun. 17, 2010

(86) PCT No.: PCT/DE2010/000694

§ 371 (c)(1), (2), (4) Date: Mar. 12, 2012

(87) PCT Pub. No.: WO2010/149134

PCT Pub. Date: Dec. 29, 2010

(65) Prior Publication Data

US 2013/0021124 A1 Jan. 24, 2013

(30) Foreign Application Priority Data

Jun. 24, 2009 (DE) ..... 10 2009 030 479

(51) Int. Cl.
*H01F 7/00* (2006.01)

(52) U.S. Cl.
USPC ..... 335/229; 335/234

(58) Field of Classification Search
USPC ..... 335/229, 234
See application file for complete search history.

(56) References Cited

U.S. PATENT DOCUMENTS 3,022,450 A * 2/1962 Chase, Jr. ..... 361/194
3,755,766 A * 8/1973 Read, Jr. ..... 335/229
3,783,423 A * 1/1974 Mater et al. ..... 335/174
3,792,390 A * 2/1974 Boyd ..... 335/229
3,893,052 A 7/1975 Kotos et al.

(Continued)

FOREIGN PATENT DOCUMENTS

| | | | |
|---|---|---|---|
| CA | 2 271 327 | A1 | 11/1999 |
| DE | 8 619 497 | U1 | 9/1986 |
| DE | 8 900 779 | U1 | 5/1989 |
| DE | 9 419 010 | U1 | 3/1996 |
| DE | 19 646 243 | C1 | 10/1997 |
| DE | 19 722 013 | C2 | 12/1998 |
| DE | 10 343 338 | A1 | 4/2005 |
| JP | 2005 166 429 | A | 6/2005 |
| JP | 2005 268 031 | A | 9/2005 |
| JP | 2005 340 703 | A | 12/2005 |
| JP | 2006 051 055 | A | 2/2006 |
| WO | WO 2008135670 | A1 | 11/2008 |

*Primary Examiner* — Alexander Talpalatski
(74) *Attorney, Agent, or Firm* — Cheryl F. Cohen; Christa Hildebrand

(57) ABSTRACT

A magnetic trigger mechanism with a yoke with armature opening. The armature is coaxially surrounded by a coil having an excitation coil, which is acted on by a force of a preloaded spring and which remains in a first end position due to magnetic holding force of a permanent magnet when there is no current flowing through the excitation coil. The permanent magnet is arranged at a first end of the armature and the second end position of the armature being achieved by a brief flow of current through the excitation coil together with the accompanying lowering of the magnetic holding force and the spring force. The first end of the armature is guided in the coil body, and the second end position, which faces the armature opening, is guided by a centering ring, the highly permeable centering ring rests against the yoke at the armature opening and can move.

8 Claims, 2 Drawing Sheets

(56) References Cited

U.S. PATENT DOCUMENTS

| | | | | | |
|---|---|---|---|---|---|
| 3,922,957 | A | | 12/1975 | Ogle et al. | |
| 4,127,835 | A | * | 11/1978 | Knutson | 335/266 |
| 4,442,418 | A | * | 4/1984 | Myers | 335/230 |
| 4,462,013 | A | | 7/1984 | Ueda et al. | |
| 4,660,012 | A | * | 4/1987 | Bonniau et al. | 335/234 |
| 4,910,487 | A | * | 3/1990 | Kleinhappl | 335/234 |
| 5,010,911 | A | * | 4/1991 | Grant | 251/65 |
| 5,387,892 | A | | 2/1995 | Rossetti et al. | |
| 5,584,466 | A | * | 12/1996 | Fukano et al. | 251/65 |
| 6,646,529 | B1 | | 11/2003 | Kahnert et al. | |
| 6,752,371 | B2 | * | 6/2004 | Herbert et al. | 251/54 |
| 8,106,734 | B2 | * | 1/2012 | Gruden | 335/229 |
| 2006/0243938 | A1 | | 11/2006 | Ishibashi et al. | |

* cited by examiner

MAGNETIC TRIGGER MECHANISM

This is an application filed under 35 USC §371 of PCT/DE2010/000694, claiming priority to DE 10 2009 030 479.7 filed on Jun. 24, 2009.

BACKGROUND OF THE INVENTION

The invention relates to a magnetic trigger which has at least a yoke having an armature opening, an armature disposed inside yoke, wherein the armature is coaxially surrounded by at least one section of the coil body having at least one excitation coil and is biased by the force of a preloaded spring element, wherein when current is not flowing through the excitation coil, the armature remains in a first end position due to the magnetic holding force of a permanent magnet, wherein the permanent magnet together with a socket extending between the armature and the permanent magnet are arranged in the area of the first end of the armature, and the second end position of the armature is attained by briefly flowing a current through the excitation coil together accompanied by a reduction of the magnetic holding force and the simultaneously effective spring force.

Many variants of bistable magnetic triggers or trigger magnets constructed in this manner are employed in high-power switches and other devices.

Solutions have been disclosed in the prior art, for example in U.S. Pat. No. 3,922,957. CA 0227 1327, U.S. Pat. No. 3,893,052, U.S. Pat. No. 3,792,390, JP 2006 051 055, U.S. Pat. No. 6,646,529, U.S. Pat. No. 5,387,892, JP 2005 166 429. JP 2005 268 031 or JP 2005 340 703.

Important requirements for trigger magnets are hereby a short trigger time, low energy consumption for triggering as well as a large ratio between the released mechanical energy and the electrical trigger energy or energy yield.

Short trigger times can be achieved, for example, with a low armature mass, as taught in JP 2005 268 031 or CA 0227 1327 which use a drilled-out armature.

The object of switching with only a low trigger energy can be achieved with a bypass in the magnetic circuit, as disclosed in U.S. Pat. No. 3,922,957 or U.S. Pat. No. 3,792,390.

A large amount of mechanical energy is released with a predetermined spring force, when the spring constant is small and the stroke is large. This is achieved, in particular, with externally arranged springs, as disclosed for example in JP 2005 166 429.

The solutions disclosed in the state-of-the-art are frequently strongly optimized only with respect to a single parameter, for example installation space, force or trigger time. The trigger parameters then scatter over a wide range. A significant underlying reason is the play in the armature guidance resulting from the structure. Due to the tolerances in the housing and in the alignment of the parts during assembly, the armature is slightly tilted with respect to the socket. Transverse forces between the armature and the housing additionally tilt the armature. Conventional structure are unable to compensate for this tilt. Tighter guides would also cause jamming.

The spring is guided directly on the armature, unless the spring is located outside the magnetic circuit or inside the armature. The spring constant then remains relatively high and the energy yield is relatively small. However, the solutions advantageous for the spring constant make it difficult to guide the armature and/or orient the armature on the socket.

However, large metallic friction is observed when the spring is guided in the armature. The spring then tends to buckle. Both effects are undesirable.

BRIEF SUMMARY OF THE INVENTION

It is therefore the object of the invention to propose a magnetic trigger which has a small trigger energy and simultaneously a high energy yield and a short trigger time.

According to the concept of the invention, the magnetic trigger includes at least one yoke encompassing an armature opening, wherein an armature, which is coaxially encompassed by at least in one section of the coil body having at least one excitation coil and which is biased by the force of a pretensioned spring element, is disposed inside the yoke. The pushed-in and not extended armature remains, when no current flows through the excitation coil, in a first end position, where it is held, due to the magnetic holding force of a permanent magnet. The permanent magnet together with a socket extending between the armature and permanent magnet are arranged in the region of the first end of the armature. The second end position of the armature is attained by briefly flowing a current through the excitation coil, accompanied by a reduction in the magnetic holding force and simultaneously in the effective spring force. It is a characteristic feature of the invention that the first end of the armature facing away from the armature opening is centrally guided in the coil body and that the second end of the armature facing the armature opening is also centrally guided by a centering ring which is centered in the coil body. Very small structural air gap dimensions between the armature and the centering ring can thereby be attained. The centering ring made of a highly permeable material rests against the yoke on the armature opening, makes direct metallic contact and is axially movable to compensate tolerances. The socket is hereby also centered in the coil body, wherein the centering ring in conjunction with the coil body ensure the planar contact of the armature in the region of the first end without tilting and furthermore ensures maximum holding forces due to the planar contact of the armature. Moreover, the spring element has a greater diameter than the armature and the magnetic flux commutates upon triggering from a series connection to a parallel connection.

A short current pulse in the excitation coil generates a magnetic field in the armature which is oriented opposite to the magnetic field of the permanent magnet. The overlap of both magnetic fields briefly displaces the magnetic flux from the armature which is then guided into the bypass (commutation). Due to the briefly strongly attenuated magnetic holding force, the spring element is able to accelerate the armature and move the armature into the second stable end position.

Centering the armature and the socket according to the invention results in a small armature play and only a very small tilt of the armature, accompanied by a reliable trigger characteristic of the magnetic trigger.

According to the invention, the armature is supported at two locations referenced across the coil body, on the second side in the coil body, on the first side in the centering ring centered in the coil body. The tolerance chain is hence short and tight fits can be selected. Consequently, a maximum guidance length and precise armature guidance is attained even with a short armature.

The magnetic trigger according to the invention is very reliable and is distinguished by highest efficiency. The scatter of the trigger parameters is strictly limited with the precise armature guidance. At the same time, the demands for high energy yield, short trigger time and small electrical trigger energy are satisfied. The invention represents a good compromise between the desired ideal values and high production reliability. With the present invention, unavoidable manufacturing tolerances can be compensated, wherein the remaining parameters satisfy the most severe demands on modern high-power switches.

The centering ring centered in the coil body is preferably made from a highly permeable material. The air gap between the second end of the armature and the centering ring remains very small due to the precise armature guidance. This reduces the magnetic resistance and the required trigger energy.

Of the torsion resistance of the anchor can be easily realized, when needed, by a positive form-lock in the coil body. To this end, the armature must be at least partially slightly flattened. Independent of the implementation of torsion resistance, the outside contour of the first end of the armature and the inside contour of the section of the coil body guiding the armature correspond to one another, or are constructed to fit into one another.

It is important for the invention that the socket is stepped by forming a centrally placed journal, wherein the journal is fixedly pressed into the hollow-cylindrical coil body, and the end face of the coil body facing away from the armature opening has a small contact surface formed by a collar or by cams, with which the coil body is seated on the socket. Because the coil body and the socket contact each other only in the region of the collar, the coil body can be precisely aligned with the journal of the socket. The armature, the coil body and the socket have a common longitudinal axis, preventing the armature from tilting.

The centering ring is not centered in the armature opening in the housing, but is instead radially movable with respect to the armature opening. There is no redundancy and all tolerance-sensitive components are aligned with one another in the coil body. This results in a very stable trigger characteristic with a small scatter in the magnetic field.

In an advantageous embodiment of the invention, the section of the coil body which encompasses the first end of the armature in a sleeve-like fashion receives the spring element which extends coaxially in relation to the armature in a groove of the coil body. According to the invention, the diameter of the spring element is greater than the diameter of the armature. In this way, a shorter spring element with a smaller spring constant can be used. The magnetic trigger can release approximately 20% more energy than conventional spring elements, with the same maximum spring force and the same dimensions. Optionally, the coil body may have a hollow-cylindrical or sleeve-shaped guide, in which both the first end of the armature as well as the journal of the socket are guided.

The spring element which is embodied as a compression spring is guided in the coil body which is preferably made of plastic. Friction is reduced compared to metallic guides and/or coil bodies. By placing the spring element coaxially inside a specifically provided groove in relation to the coil body, the buckling characteristic is positively affected due to the larger diameter of the spring element compared to the armature cross-section, resulting in a further reduction of the friction. Reduced friction reduces abrasion in the working gap and results in a more stable behavior of the magnetic trigger. Due to the smaller scatter of the magnetic holding force, the safety margin can be reduced, so that the overall magnetic holding force can be reduced while maintaining the same spring force. This reduced magnetic holding force requires less trigger energy and has a significant advantage compared to conventional solutions. Furthermore, the large diameter of the spring element reduces the spring constant and increases the energy yield by up to about +20% and decreases the trigger time. Conversely, the invention enables smaller magnetic holding forces with the same spring force in the "released" position.

In a particularly advantageous modification of the invention, to protect the permanent magnet as well as to dampen the impact of the armature when the armature returns to or assumes its first end position, a nonmagnetic elastic foil is placed either between the socket and the permanent magnet or a spacer ring encompassing the permanent magnet is provided for supporting the socket, wherein the required air gap is defined by the different thicknesses of the permanent magnet and the spacer ring. With these two measures, the characteristic curve of the magnet is sheared, which reduces the tolerance sensitivity during triggering. The permanent magnet is protected from outside forces in both of the aforementioned cases.

The principle of flux commutation is hereby particularly advantageously employed and substantially helps minimize the required trigger energy. The required parallel connection is hereby defined by an air gap between the socket and the housing. The magnetic resistance decreases, so that the magnetic holding force can be more strongly reduced with less current flowing through the coil. When this principle is consequently applied, at least 30% of the flux of the permanent magnet is conducted via the bypass. When current flows through the excitation coil, the magnetic field of the excitation coil displaces the magnetic flux generated by the permanent magnet from the armature into the bypass.

A nonmagnetic coating of the end side of the journal of the socket facing the armature reduces scatter in the magnetic holding force.

The significant advantages and features of the invention compared to the state-of-the-art are essentially:

- Very reliable magnetic trigger with highest efficiency,
- Armature guidance is improved with the two bearing locations arranged in the region of the first end of the armature and in the region of the second end of the armature, namely a section of the coil body and the centering ring,
- Armature tilt is reduced by, on one hand, fixedly pressing the journal of the socket into the coil body and seating the end face of the coil body on the socket with only a narrow ring-shaped collar or cam, and on the other hand, in that the armature, the coil body and the socket with its journal have a common longitudinal axis, and
- Increased release of energy of the spring element by making the diameter of the spring element greater than the diameter of the armature by placing the spring element in a coaxially extending groove of the coil body,
- Reducing the required trigger energy by forming a bypass extending between the outer surfaces of the socket and the inner wall of the housing or yoke,
- Damping the impact of the armature when the armature returns or moves into its first end position by placing a so-called air gap foil between the permanent magnet and the socket, and
- Reducing scatter in the magnetic holding force by coating the socket with a nonmagnetic layer.

The object and advantages of the invention can be better understood and evaluated after a careful study of the following comprehensive description of preferred, but not limiting exemplary embodiments of the invention with the appended drawings, which show in:

DETAILED DESCRIPTION OF THE INVENTION

Figure 1:
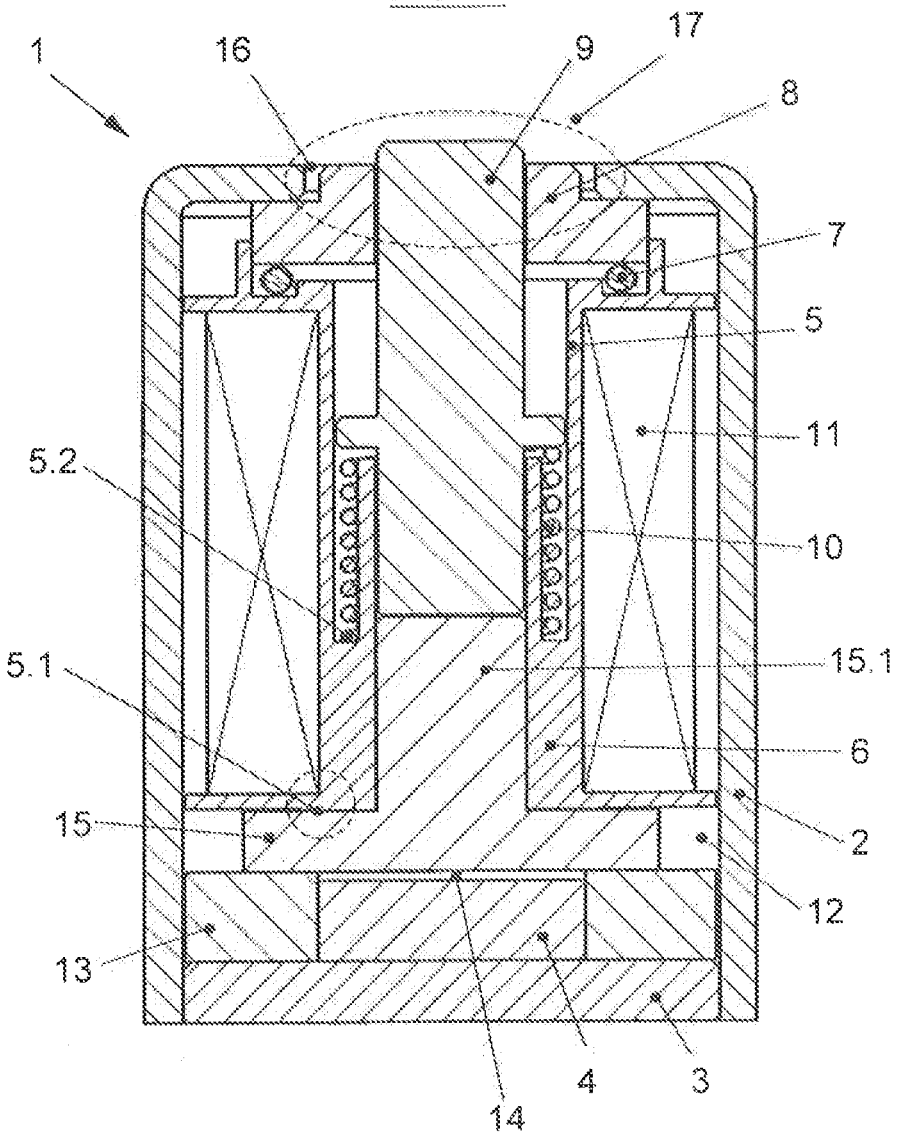
FIG. 1 a cross-sectional view of the magnetic trigger.

FIG. 1 shows a cross-sectional view of the magnetic trigger 1 according to the invention. The yoke 2 of the magnetic trigger 1 is made of a housing or frame with an armature opening 17 disposed on a first end face and a base plate for closing the housing disposed on a second opposite end face. An excitation coil 11 as well as a coil body 5 receiving the excitation coil 11 are disposed inside the yoke 2. The coil body 5 has a guide constructed as a guide sleeve which is provided with a coaxial groove 5.2. A spring element 10 formed as a compression spring is disposed in this groove 5.2. The armature 9 is guided in one half of the guide sleeve. The journal 15.1 of the socket 15 which is made of a highly permeable material is pressed into the other half of the guide sleeve. The second end of the armature 9 facing the armature opening 17 is additionally guided through a centering ring 8 disposed in the armature opening 17. The tolerance chain thus remains short and the armature 9 as well as the socket 15 are oriented exactly parallel with respect to one another. This ensures a reliable planar contact between the end faces of armature 9 and the socket 15, which makes the trigger characteristic more stable. Arranged subsequent to the socket 15 is an air gap foil which defines the spacing between a permanent magnet 4 and the socket 15. The permanent magnet 4 is encompassed by a spacer ring 13. The parallel connection is formed by the air gap between the socket 15 and the yoke 2. When current is not flowing through the excitation coil 11, the pushed-in or retracted armature 9 remains in a first end position due to the magnetic holding force of the permanent magnet 4. The magnetic holding force of the permanent magnet 4 is interrupted with a short current pulse and the spring element 10 formed as a compression spring moves the armature 9 into its second end position. The compression spring engages approximately at the center of the armature 9 with a positive lock and is also guided by this positive lock. The second end of the compression spring is supported in the coil body 5, in particular in the guide groove 5.2 of the coil body 5. The coil body 5 includes an (only outlined) groove disposed on the end face facing the armature opening 17, in which an additional spring element 7, for example an elastomer or a resilient ring, is placed. The spring element 7 is employed to reduce play, to press for centering ring 8 against the armature opening 17 of the yoke 2, and to thereby ensure magnetic contact between the centering ring 8 and the yoke 2. If necessary, the structure allows radial play between the centering ring 8 and the yoke 2 for compensating tolerances. This eliminates static redundancy and prevents the armature 9 from jamming even with tight guide tolerances. All tolerance-sensitive components remain aligned in the coil body 5. In this way, a very stable trigger characteristic with only small scatter is achieved. The centering ring 8 may be constructed as a flat disk or, as illustrated, may have an additional shoulder.

Figure 2:
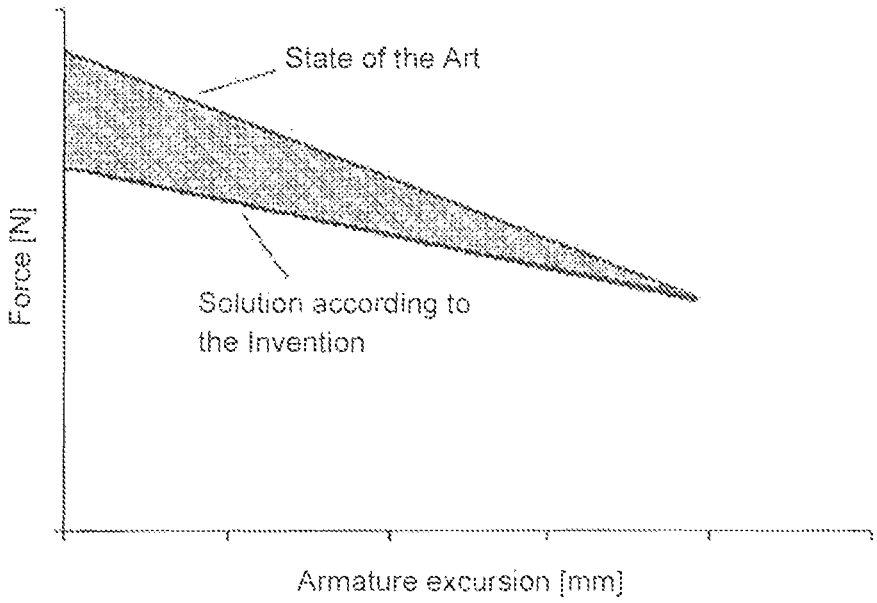
FIG. 2 a schematic diagram of spring characteristic curves.

FIG. 2 shows a schematic diagram of two different spring characteristic curves. The first spring characteristic curve hereby represent the state-of-the-art and a second spring characteristic curve corresponds to the magnetic trigger according to the invention. The armature excursion is shown on the x-axis in mm and the spring force is shown on the y-axis. The spring characteristic curve according to state-of-the-art is significantly steeper than the spring characteristic curve of the magnetic trigger according to the invention. In other words, with the same force in the "released" position, the required magnetic holding force is reduced by about 20%. The required trigger energy can thus be reduced commensurately.

Figure 3:
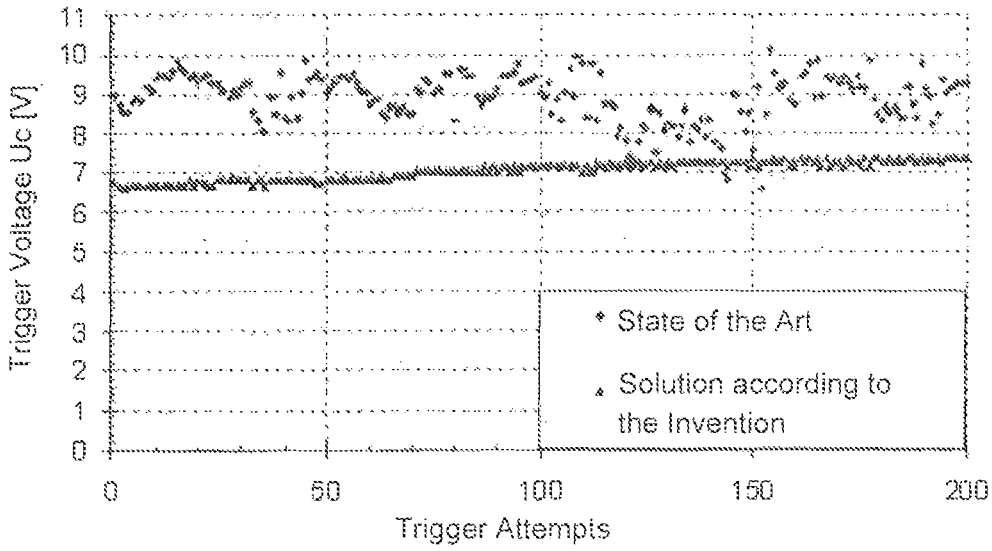
FIG. 3 a schematic diagram of the scatter in the trigger voltage.

FIG. 3 shows a schematic diagram of the scatter in the trigger voltage. The number of attempts is shown on the x-axis and the trigger voltage on the y-axis. The scatter of a conventional switch or magnet trigger is compared with the scatter of the magnet trigger according to the invention. Due to the short tolerance chain and the exact alignment between the armature and the socket, the scatter in the design according to the invention is significantly smaller.

LIST OF REFERENCES SYMBOLS

1 Magnetic trigger
2 Yoke
3 Base
4 Permanent magnet
5 Coil body
5.1 Collar, cam
5.2 Groove
6 Guide
7 Spring element
8 Centering grain
9 Armature
10 Spring element
11 Excitation coil
12 Bypass
13 Spacer ring
14 Foil
15 Socket
15.1 Journal
16 Gap
17 Armature opening

The invention claimed is:

1. A magnetic trigger (1), comprising at least one yoke (2) encompassing an armature opening (17), an armature (9) is disposed inside the yoke, the armature (9) being coaxially surrounded by at least one section of a coil body (5) having at least one excitation coil (11) and biased by a force from a preloaded spring element (10), wherein the armature (9) remains in a first end position due to the magnetic holding force of a permanent magnet (4) when current is not flowing through the excitation coil (11), wherein the permanent magnet (4) together with a socket (15) extending between the armature (9) and the permanent magnet (4) are arranged in an area of a first end of the armature (9), and wherein a second end position of the armature (9) is attained by briefly flowing a current through the excitation coil (11) accompanied by a reduction in the magnetic holding force and the then effective spring force, wherein (a) the first end of the armature (9) facing away from the armature opening (17) is centrally guided and the second end of the armature (9) facing the armature opening (17) is centrally guided by a centering ring (8) centered in the coil body (5), (b) the centering ring (8) is highly permeable and abuts the yoke (2) on the armature opening (17) and is radially movable relative to the yoke, (c) the socket (15) is centered in the coil body (5), wherein the centering ring (8) in conjunction with the coil body (5) secure a planar contact of the armature (9) in the region of the first end without tilt and ensures always maximum holding forces through the planar contact of the armature (9), (d) the spring element (10) has a greater diameter than the armature (9), and (e) the magnetic flux commutates upon triggering from a series connection to a parallel connection.

2. The magnetic trigger (1) according to claim 1, wherein the socket (15) is stepped by forming a centrally placed journal (15.1), wherein the journal (15.1) is firmly pressed in direct physical contact with the hollow-cylindrical coil body (5), and the end face of the coil body (5) facing away from the armature opening (17) has a small contact surface formed by a collar (5.1) or by cams (5.1), with which the coil body (5) is seated on the socket (15).

3. The magnetic trigger (1), comprising at least one yoke (2) encompassing an armature opening (17)

an armature (9) is disposed inside the yoke, the armature (9) being coaxially surrounded by at least one section of a coil body (5) having at least one excitation coil (11) and biased by a force from a preloaded spring element (10), wherein the armature (9) remains in a first end position due to the magnetic holding force of a permanent magnet (4) when current is not flowing through the excitation coil (11), wherein the permanent magnet (4) together with a socket (15) extending between the armature (9) and the permanent magnet (4) are arranged in an area of a first end of the armature (9), and wherein a second end position of the armature (9) is attained by briefly flowing a current through the excitation coil (11) accompanied by a reduction in the magnetic holding force and the then effective spring force, wherein (a) the first end of the armature (9) facing away from the armature opening (17) is centrally guided and the second end of the armature (9) facing the armature opening (17) is centrally guided by a centering ring (8) centered in the coil body (5), (b) the centering, ring (8) is highly permeable and abuts the yoke (2) on the armature opening (17) and is radially movable relative to the yoke, (c) a socket (15) is centered in the coil body (5), wherein the centering ring in conjunction with the coil body (5) secure a planar contact of the armature (9) in the region of the first end without tilt and ensures always maximum holding forces through the planar contact of the armature (9), (d) the spring element (10) has a greater diameter than the armature (9), and (e) the magnetic flux commutates upon triggering from a series connection to a parallel connection and wherein the section of the coil body (5) which encompasses the first end of the armature (9) in form of a sleeve receives the spring element (10), which spring element (10) extends coaxially with respect to the armature (9) in a groove (5.2) of the coil body (5).

4. The magnetic trigger (1) according to claim 1, wherein the coil body (5) comprises a sleeve-shape guide (6), in which both the first end of the armature (9) and the journal (15.1) of the socket (15) are guided.

5. The magnetic trigger (1) according to claim 1, wherein for protecting the permanent magnet and for damping the impact of the armature (9) when the armature (9) returns to or assumes its first end position (a) a nonmagnetic elastic foil (14) is placed between the socket (15) and the permanent magnet (4), and/or (b) a spacer ring (13) encompassing the permanent magnet (4) is provided, which supports the socket (15), wherein the required air gap is defined by the different thicknesses of the spacer ring (13) and of the permanent magnets (4).

6. A magnetic trigger (1), comprising at least one yoke (2) encompassing an armature opening (17), an armature (9) is disposed inside the yoke, the armature (9) being coaxially surrounded by at least one section of a coil body (5) having at least one excitation coil (11) and biased by a force from a preloaded spring element (10), wherein the armature (9) remains in a first end position due to the magnetic holding force of a permanent magnet (4) when current is not flowing through the excitation coil (11), wherein the permanent magnet (4) together with a base (15) extending between the armature (9) and the permanent magnet (4) are arranged in an area of a first end of the armature (9), and wherein a second end position of the armature (9) is attained by briefly flowing a current through the excitation coil (11) accompanied by a reduction in the magnetic holding force and the then effective spring force, wherein (a) the first end of the armature (9) facing away from the armature opening (17) is centrally guided and the second end of the armature (9) facing the armature opening (17) is centrally guided by a centering ring (8) centered in the coil body (5), (b) the centering ring (8) is highly permeable and abuts the yoke (2) on the armature opening (17) and is radially movable relative to the yoke, (c) the base (15) is centered in the coil body (5), wherein the centering ring (8) in conjunction with the coil body (5) secure a planar contact of the armature (9) in the region of the first end without tilt and ensures always maximum holding forces through the planar contact of the armature (9), (d) the spring element (10) has a greater diameter than the armature (9), and (e) the magnetic flux commutates upon triggering from a series connection to a parallel connection, wherein the socket (15) is designed to form an air gap between the socket (15) and the yoke (2), wherein the air gap produces a bypass (12) in the magnetic circuit as a parallel connection.

7. The magnetic trigger (1) according to claim 1, wherein the socket (15) has a nonmagnetic coating for defining the gap between the armature (9) and, the socket (15) and for reducing the tolerance sensitivity.

8. The magnetic trigger (1) according to claim 1, wherein the preloaded spring element (10) is not guided directly on the armature (9).

* * * * *